United States Patent [19]

Spelts

[11] 4,226,291

[45] Oct. 7, 1980

[54] REAMER STABILIZER FOR ROCK DRILLS

[76] Inventor: William R. Spelts, P.O. Box 208, Logan Lake, British Columbia, Canada, V0K 1W0

[21] Appl. No.: 11,873

[22] Filed: Feb. 13, 1979

[51] Int. Cl.[2] ..... E21B 9/22; E21C 17/00

[52] U.S. Cl. ..... 175/325; 175/347

[58] Field of Search ..... 175/325, 326, 344–347, 175/361–364; 166/241; 308/4 A

[56] References Cited

U.S. PATENT DOCUMENTS

| | | | |
|---|---|---|---|
| 2,122,763 | 7/1938 | Smith, Jr. | 175/346 |
| 2,189,030 | 2/1940 | Harrington | 175/346 |
| 3,658,141 | 4/1972 | Schumacher, Jr. | 175/364 |
| 3,705,750 | 12/1972 | Crow | 175/364 X |

*Primary Examiner*—James A. Leppink

*Attorney, Agent, or Firm*—Carver & Company

[57] ABSTRACT

A reamer and stabilizer assembly for rock drills having a substantially cylindrical body provided with a threaded end socket for connection to a drill stem, the body having circumferentially spaced longitudinally extending recesses for receiving reaming and stabilizer rollers mounted on axles extending parallel to the axis of the body, each reamer and roller assembly being removably retained in its recess by a keeper pin which can be inserted or retracted through a keeper pin passage opening into the threaded socket and into a longitudinal passage through each axle.

5 Claims, 5 Drawing Figures

REAMER STABILIZER FOR ROCK DRILLS

BACKGROUND OF THE INVENTION

1. Field of the Invention

This invention relates to rock drilling apparatus, and in particular to reamer and stabilizer asemblies adapted to be fitted between the bit and drill stem.

2. Prior Art

In rock drills it is customary to utilize a stabilizer reamer between the bit of the rock drill and the drill stem. With the stabilizer thus installed, the bit which normally has a tendency to wander is somewhat directionally stabilized so that drilling follows a straight course.

The stabilizer units, which are secured at one end to the bit and at one end to the drill stem, usually have three or more roller assemblies which lie on a circle having a diameter approximately the same as the drill bit so as to have a tight, yet rotatable, fit in the hole drilled by the bit. The stabilizing rollers do actually perform a reaming function in many cases as they are provided with bits or protrusions which remove certain anomolies in the drill hole caused by the action of the bit.

In those stabilizer reamers wherein more of a stabilizing, rather than reaming, function is performed, the stabilizer rolls are usually of a cylindrical nature and mounted for rotation on axles which extend parallel to the rotational axis of the bit. After much usage the roller bits quite frequently wear as do the bearings between the axles and the rollers, and it is quite often necessary to change the stabilizer rolls from time to time.

In most reamer and stabilizing units of prior art, the axles on which the rolls are mounted are usually held in place on the stabilizer body by exteriorily available screws or studs which are themselves subject to wear during an operation and, consequently, the removal and replacement of rolls becomes a work-shop rather than on-the-spot operation, and special tools are required. Consequently, unless there is a stabilizer unit immediately at hand to replace the entire worn stabilizer unit, the down time becomes excessive.

SUMMARY OF THE INVENTION

The present invention provides a reamer stabilizer apparatus having removable reamer and stabilizer rolls which are secured in position to be removed and replaced on site by the drill operators and thus reduce down-time normally experienced in operations of this nature.

The reamer and stabilizer apparatus of the present invention has an elongated cylindrical body having a threaded socket at one end for connection to the threaded end of a drill stem, the body also having circumferentially spaced recesses having opposite end walls, each end wall having an outwardly opening radially extending seat, a roller axle having a roller mounted thereon for each recess, each axle having extending portions slidably received by the seats, each axle having a longitudinally extending bore, the body having a keeper pin passage extending between the threaded socket and a seat aligned with the axle bore and a socket at the opposite seat aligned with the bore, a keeper pin adapted to extend through the passage and bore for engagement at the opposite end with the last mentioned socket and means detachably secured to the body in said last mentioned threaded socket for restraining the keeper pin.

In another aspect of the invention, each keeper pin has a longitudinally extending fluid passage for receiving drilling fluid pumped into the last mentioned threaded socket and an intersecting fluid passage aligned with a lateral fluid passage in the associated axle for enabling flow of fluid between the axle and its associated roller.

A detailed description following, related to the drawings, gives exemplification of apparatus according to the invention which, however, is capable of expression in means other than those particularly described and illustrated.

DETAILED DESCRIPTION

Figure 1:
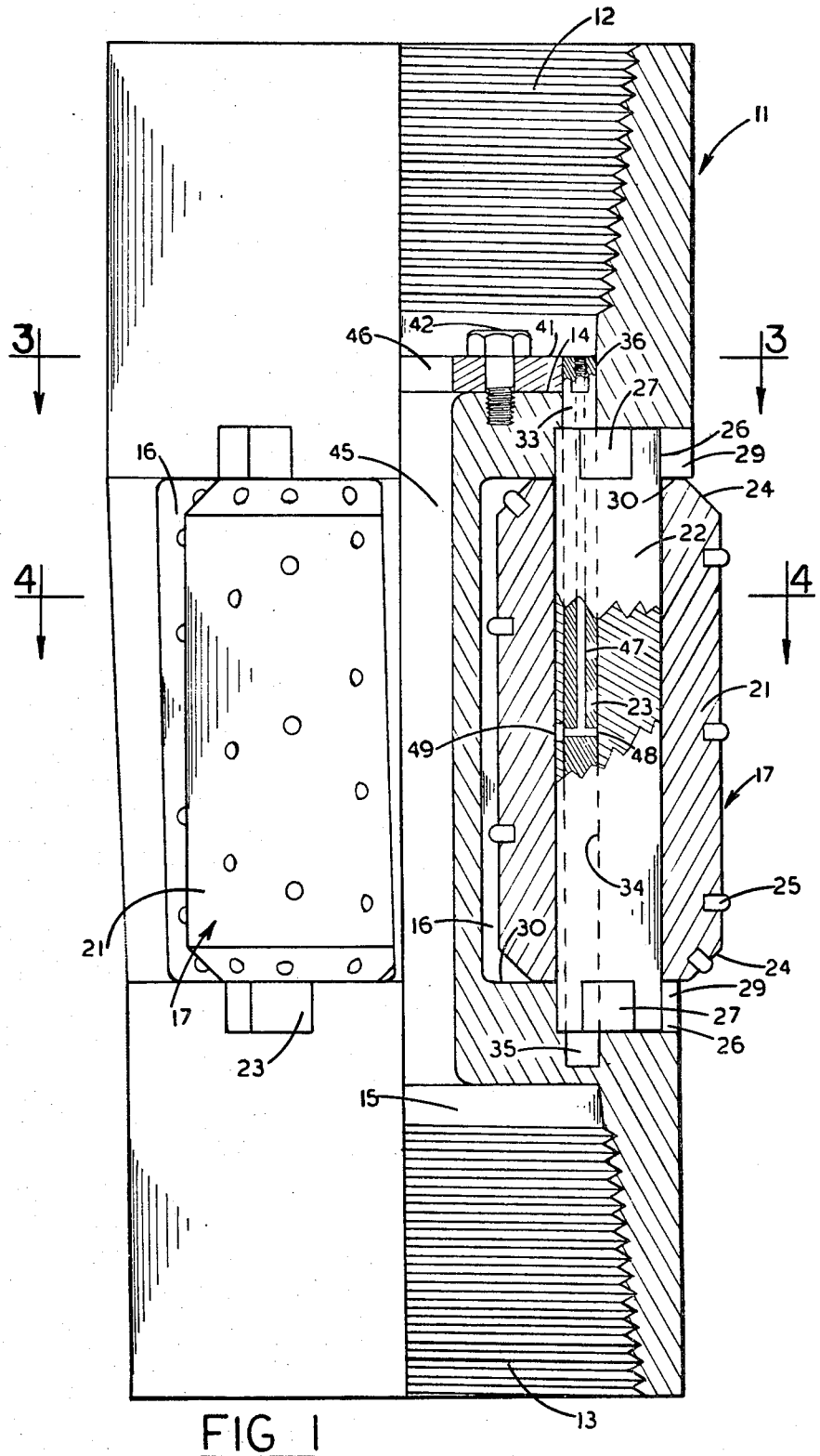
FIG. 1 is an elevation of the reamer stabilizer apparatus, partially sectioned.
Figure 2:
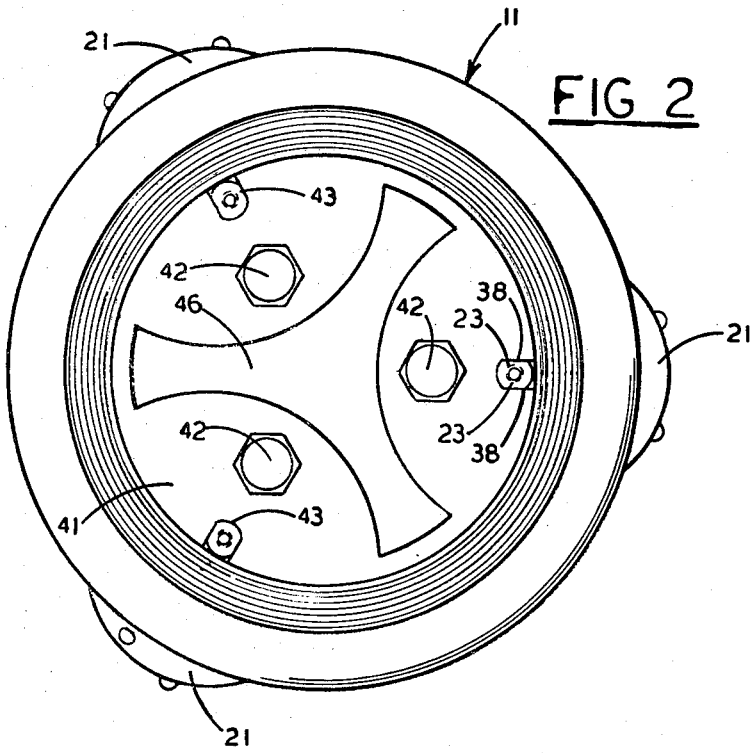
FIG. 2 is an end view thereof.
Figure 5:
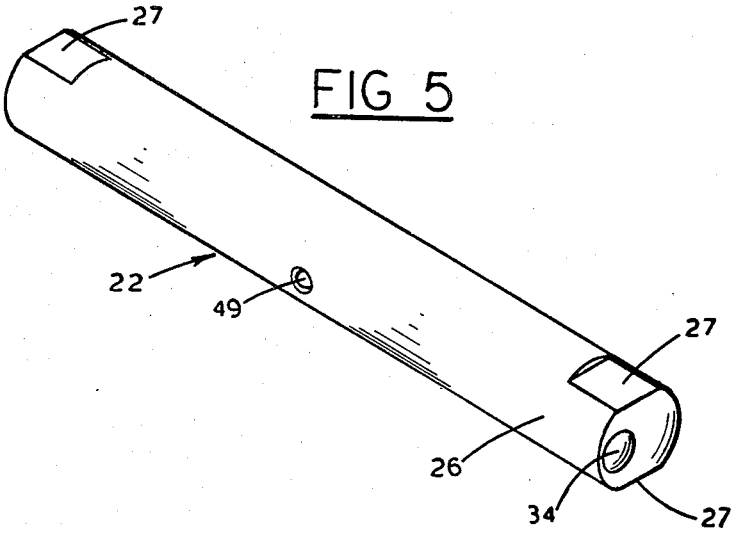
FIG. 5 is a perspective view of a roller axle.

Referring to the drawings, and in particular to FIG. 1, there is shown the reamer and stabilizer apparatus of the present invention which is adapted to be connected between a threaded male end of a lower-most section of drill stem (not shown) and the threaded male end (not shown) of a conventional rock drilling bit. The apparatus has an elongated cylindrical body 11 having at one end a tapered threaded socket 12 which threadedly accepts the threaded male end of the drill stem and at its opposite end a similar tapered threaded socket 13 which threadedly accepts the tapered male threaded end of the conventional rock drilling bit. The socket 12 has a planar bottom 14 and the socket 13 has a planar bottom 15. The body is also provided with longitudinally extending circumferentially spaced semispherical recesses 16 within which reamer and stabilizing roller units 17 are mounted.

Figure 3:
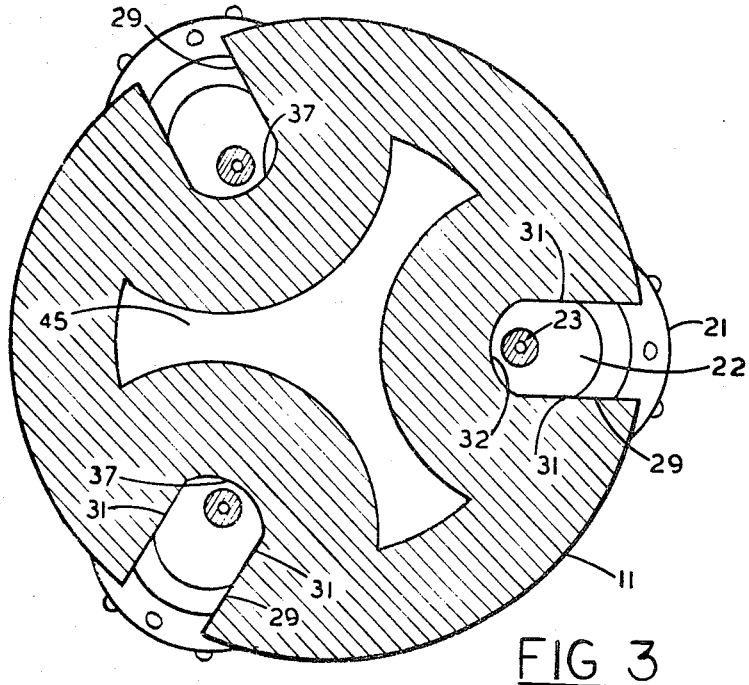
FIGS. 3 and 4 are views taken on Lines 3 and 4, respectively, of FIG. 1.
Figure 4:
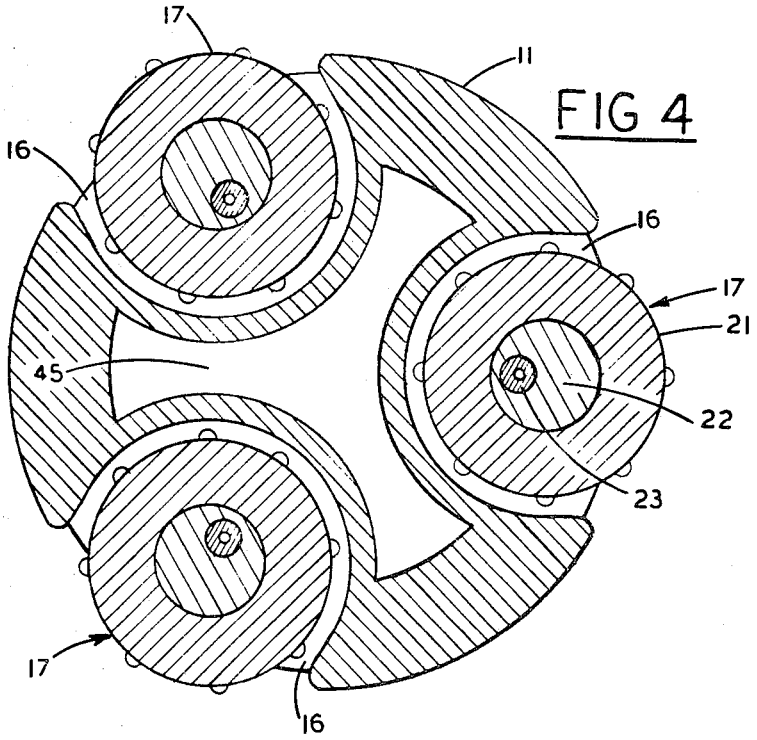

Each roller unit 17 has a roller 21, an axle 22 and a keeper pin 23. The rollers have a cylindrical configuration with slight end chamfers 24 and are studded with wear resistant material such as tungsten carbide inserts 25. The axles are slightly longer than the rollers and have projecting end portions 26—26 which are machined to provide a pair of diametrically opposed parallel flats 27—27. These end portions of the axles slidably fit in radially disposed outwardly opening seats 29 machined in end walls 30 of the recesses. The seats, it is seen, have parallel side walls 31, see FIG. 3, between which the end portions of the axles slidably fit, and inner end walls 32 engaged by the axle end portions when the later are fully inserted into the seats. With the roller units fully inserted in their associated recesses, the rollers project slightly outward of the circumference of the body and lie on an imaginary circle, the diameter of which is the same as the bit diameter.

The rollers are maintained in position within the recesses by means of the keeper pin 23. The keeper pins are slidably insertable through bores 33 extending between the socket bottom 14 and open into the recess of the seat adjacent, thence through a longitudinally extending keeper pin passage 34 formed through each axle and thence into a keeper pin socket 35 opening out of the seat adjacent to the socket bottom 15. Length of the keeper pins is such that each has an extending end portion 36 projecting into the socket 12. Each end portion 36, like the extending end portions of the axles, is provided with diametrically opposed parallel flats 38—38. The keeper pins are held in position by a keeper pin retaining plate 41 which fits against the socket bottom and is releasably secured thereto by machine bolts 42. The plate 41, it is seen, has circumferentially spaced notches 43 having parallel side walls which are fittedly received by the flats 38 of the extending end portions of the keeper pins.

In order to provide hydraulic fluid communication between the drill stem and the bit, the body 11 of the apparatus is provided with a central fluid passage 45 which is shown as having a trefoil shape to provide the greatest possible cross-sectional area compatible with strength and the plate 41 is provided with a similar central passage 46.

Construction of the apparatus also enables drilling fluid to be used as a lubricant for the rollers. Referring particularly to FIG. 1, it is seen that each of the retainer pins has an axial fluid passage 47 opening at one end through the extending end portion of each pin and which communicates substantially at the middle length of the pin with a lateral fluid passage 48, which itself communicates with a lateral fluid passage 49 formed in each axle and which opens out of the outer surface thereof. Further, to facilitate extraction of the keeper pins the open ends of the fluid passages 47 are threaded to accept a threaded extractor whereby the pins may be withdrawn through the socket 12.

It is further to be noted that dimensional relationship of the axles and the rollers relative to socket diameter is of great importance as axle diameter must be such that the keeper pins can be positioned to enable them to be withdrawn through the socket 12. As shown, the keeper pin passages through the axles are situated off-center of the latter so that the axles must have a diameter to enable this to be done. The off-center aspect of the keeper pins is of no structural importance as all the load taken by the rollers is transferred to the body through engagement of the axles with the end walls of their seats, no load being taken by the keeper pins.

It will also be evident that the apparatus, as described above, enables rollers and axles to be replaced very quickly and easily as all that is necessary for this operation is to detach the drill stem from the body, remove the plate 41 by taking out the bolts 42 and extract the keeper pins to enable the whole roller unit to be pulled outwards of the seats. As the bolts 42 are internally located, they are not subject to wear and can always be removed by tools, such as wrenches, which are normally readily available to the drilling operators.

I claim:

1. Reamer and stabilizer apparatus for rock drilling equipment comprising:

(a) an elongated body member having a threaded socket at one end for connection to a threaded end of a drill stem, (b) means at the other end of the body member for connecting a drill bit thereto, (c) the body member having a plurality of circumferentially spaced recesses having longitudinally spaced apart end walls, (d) a plurality of roller units, each unit having an axle and a roller rotatably mounted thereon, and each axle having a slidable fit between the end walls of each of the recesses, (e) each axle having a longitudinally extending keeper pin passage opening out of the ends thereof, (f) bores extending between each recess wall and threaded socket aligned with the passages through the axles, (g) keeper pin retainer sockets opening out of the opposite end walls of the recesses aligned with the bores, (h) a keeper pin extendable through the threaded socket and through each axle passage and engaging an associated keeper pin socket for releasably securing the axles within the recesses, (i) means releasably secured to the body within the threaded socket for preventing withdrawal of the keeper pins from the respective axles.

2. Apparatus as claimed in claim 1 in which each of the axles has extending end portions, said end portions having diametrically opposed flats, and seats formed in the end walls of each of the recesses for slidably receiving said axle end portions.

3. Apparatus as claimed in claim 1 in which the keeper pins have end portions extending into the socket, said end portions having diametrically opposed flats and in which the means for retaining the keeper pins connected to their respective axles comprises a plate adapted to be secured to the body against the threaded socket bottom, the plate having peripheral notches for accepting extending end portions of the keeper pins and bolts adapted to be extended through the plate into the body member.

4. Apparatus as claimed in claim 1 in which the keeper pin passages extending through the axles are located off-center of the latter.

5. Apparatus as claimed in claim 1 in which each of the keeper pins has a longitudinally extending fluid passage, a lateral passage intersecting said longitudinal passage and each axle has a lateral fluid passage normally aligned with said lateral passage through each of the keeper pins to enable passage of fluid from the threaded socket to the outer surface of each of the axles.

* * * * *